US005486121A

United States Patent [19]

Miller

[11] Patent Number: 5,486,121

[45] Date of Patent: Jan. 23, 1996

[54] ELECTRICAL CONNECTOR ASSEMBLY

[75] Inventor: Vernon R. Miller, Atlanta, Ga.

[73] Assignee: The Whitaker Corporation, Wilmington, Del.

[21] Appl. No.: 271,683

[22] Filed: Jul. 7, 1994

[51] Int. Cl.[6] ..... H01R 25/00

[52] U.S. Cl. ..... 439/652; 439/686

[58] Field of Search ..... 439/22, 103, 76, 439/102, 650–652, 686, 695, 701

[56] References Cited

U.S. PATENT DOCUMENTS

| | | | |
|---|---|---|---|
| 3,868,161 | 2/1975 | Frantz | 339/14 R |
| 3,951,489 | 4/1976 | Bromberg | 339/14 R |
| 3,951,502 | 4/1976 | Bromberg | 339/99 R |
| 3,957,336 | 5/1976 | Bromberg | 339/156 R |
| 4,090,769 | 5/1978 | Damsky | 339/156 R |
| 4,165,443 | 8/1979 | Figart et al. | 174/53 |
| 4,245,880 | 1/1981 | Zimmerman, Jr. et al. | 339/97 R |
| 4,249,789 | 2/1981 | Lee | 339/156 R |
| 4,336,418 | 6/1982 | Hoag | 439/535 |
| 4,367,007 | 1/1983 | Nickence | 439/654 |
| 4,583,799 | 4/1986 | Wiley | 339/14 R |
| 4,607,906 | 8/1986 | Munroe | 339/192 R |
| 4,775,332 | 10/1988 | Bowden, Jr. et al. | 439/650 |
| 4,830,626 | 5/1989 | Liu | 439/425 |
| 4,897,052 | 1/1990 | Priest et al. | 439/652 |
| 4,927,384 | 5/1990 | Bates | 439/494 |
| 4,934,962 | 6/1990 | Luu et al. | 439/651 |
| 4,979,907 | 12/1990 | Lee | 439/214 |
| 5,106,324 | 4/1992 | Natsume | 439/510 |
| 5,122,082 | 6/1992 | Lee | 439/652 |
| 5,137,474 | 8/1992 | Lin | 439/650 |
| 5,232,381 | 8/1993 | Yu | 439/652 |
| 5,238,430 | 8/1993 | Wan | 439/652 |
| 5,281,172 | 1/1994 | Luu | 439/651 |

FOREIGN PATENT DOCUMENTS

| | | | |
|---|---|---|---|
| 2217928 | 1/1989 | United Kingdom | 439/650 |

*Primary Examiner*—Larry I. Schwartz
*Assistant Examiner*—Jill DeMello

[57] ABSTRACT

A low-cost electrical connector assembly (1) comprises a socket subassembly (12) removably attached to a distribution subassembly (10) in predetermined inter-position. The distribution subassembly (10) includes a bus housing (8) accommodating and retaining distribution blade buses (2, 3, 4) in predetermined positions, and a bus housing cover (9) removably secured on the bus housing (8) for further supporting and retaining said distribution blade buses (2, 3, 4). The socket subassembly (12) includes a socket housing (11) retaining socket buses (5, 6, 7) in predetermined positions. Each distribution blade bus (2, 3, 4) includes a connection end (22) and a terminal end (23), respectively, and formed from an integral metal bus strip which is folded to fit into the respective predetermined compartments (19) in the bus housing (8). Each socket bus (5, 7) includes respective spaced apart parallel slits (47, 49), and the socket bus (6) includes spaced apart parallel slits (47, 48), wherein the slits (47) serve for receiving the connection end (22) of the respective distribution blade busses (2, 3, 4) and the slits (48, 49) serve for receiving entry terminals of equipment to be powered.

22 Claims, 9 Drawing Sheets

ELECTRICAL CONNECTOR ASSEMBLY

THE FIELD OF THE INVENTION

The present invention relates to the field of electrical connectors, and more particularly, to connectors using a distribution blade buses and socket buses of a "scrapless" design.

BACKGROUND OF THE INVENTION

Duplex receptacle power blocks (as, for example, the block shown in FIG. 1) include a plastic housing accommodating and retaining in predetermined positions hot, ground and neutral contacts, respectively. Each contact is stamped of metal, as shown in FIG. 2, and is folded in such a manner to provide a distribution blade bus and a socket bus, respectively, in one integral contact.

The contacts are positioned and retained within the plastic housing in precise registration of the socket buses with respective apertures in the front surface of the plastic housing. These apertures in the housing receive the respective terminals of an entry adapter (not shown) of compatible equipment.

The distribution blade buses, on the other hand, protrude through respective slots in the plastic housing cover (not shown) and are plugged into a suitable power supply.

Unfortunately, as can be seen from FIG. 2, the contacts of the above-mentioned connectors are made from a relatively wide strip of material which is blanked (or punched out) and then formed. This process creates a lot of scrap, thereby making the contacts costly.

Therefore, it would be highly desirable to have a more cost effective method for making contacts for an electrical connector assembly.

SUMMARY OF THE INVENTION

It is, therefore, an object of the present invention to provide a cost effective electrical connector assembly employing distribution blade buses and socket buses made from a minimum width strip of material, thereby providing a "scrapless" design.

It is another object of the present invention to provide a connector assembly including a distribution subassembly and a socket subassembly, easily secured to each other without the use of additional fastening means or steps.

It is yet another object of the present invention to provide a method of assembling an electrical connector assembly.

In accordance with the teaching of the present invention, a connector assembly includes a socket subassembly removably attached to a distribution subassembly in predetermined inter-position. The distribution subassembly includes a bus housing accommodating and retaining distribution blade buses (hot, neutral and ground, respectively) in predetermined positions defined by respective internal walls, and a bus housing cover secured to the bus housing for further supporting and retaining the respective distribution blade buses within the bus housing. The socket subassembly includes a socket housing retaining socket buses (hot, neutral and ground, respectively) in predetermined positions defined by respective internal walls.

Each distribution blade bus is made from an integral metal bus strip of a respective minimum uniform width, and each distribution blade bus includes a connection end and a terminal end, respectively, integrally connected at a right angle to each other. The bus strips are folded to fit into the respective predetermined positions in the bus housing. Each socket bus is made from an integral metal socket strip of a respective minimum uniform width having spaced-apart parallel first, second and third slits. The first slits serve for receiving the connection end of the respective bus strip. The second and third respective slits serve for receiving entry terminals of equipment to be powered. The slits in the socket bus are lanced out such that no material is scrapped from each strip of material.

A thin snap-on faceplate is removably attached to the receptacle housing.

To assemble the connector assembly, as described above, the distribution blade buses are positioned into the respective compartments of the bus housing in predetermined order, and the bus housing cover is secured to the bus housing (snapped or heat staked thereon) thereby forming a distribution subassembly. The socket buses are positioned into respective compartments of the socket housing, thereby forming a socket subassembly. Further, the socket subassembly is secured to the distribution subassembly such that the connection ends of the respective distribution blade buses are received within the respective slits of the respective socket buses.

Viewed in another aspect, the present invention constitutes an electrical device which includes a bus (socket bus) formed from a metal strip and at least one input blade (distribution blade bus). The bus includes a plurality of sockets, each defined by a slit extending longitudinally along a portion of the bus and a portion of the bus adjacent the slit extending transversely of the bus. Each bus is symmetrical relative to its longitudinal axis. At least one of the sockets is configured to receive the input blade configured for connection to a source of electricity and at least one of the sockets is configured to receive an output blade from a second electrical device (the electrical device to be powered). Each socket is formed by at least two portions of the bus on opposite sides of the slit. Said two portions of the bus extend in opposite transverse directions. The bus and the input blade are mounted in a housing which includes an opening through which the input blade from the second electrical device can be inserted. The input blade extends into the bus from a first direction transverse to the longitudinal axis of the slit forming its corresponding socket. The housing opening extends from an opposite direction also transverse to the longitudinal axis of the slit forming its corresponding socket. The input blade is flat and the socket for receiving the output blade is configured to receive a substantially round pin on a grounding electrical plug. The input blade has flat terminal portions on each end.

These and other objects of the present invention will become apparent from a reading of the following specification taken in conjunction with the enclosed drawings.

DETAILED DESCRIPTION OF THE INVENTION

Figure 1:
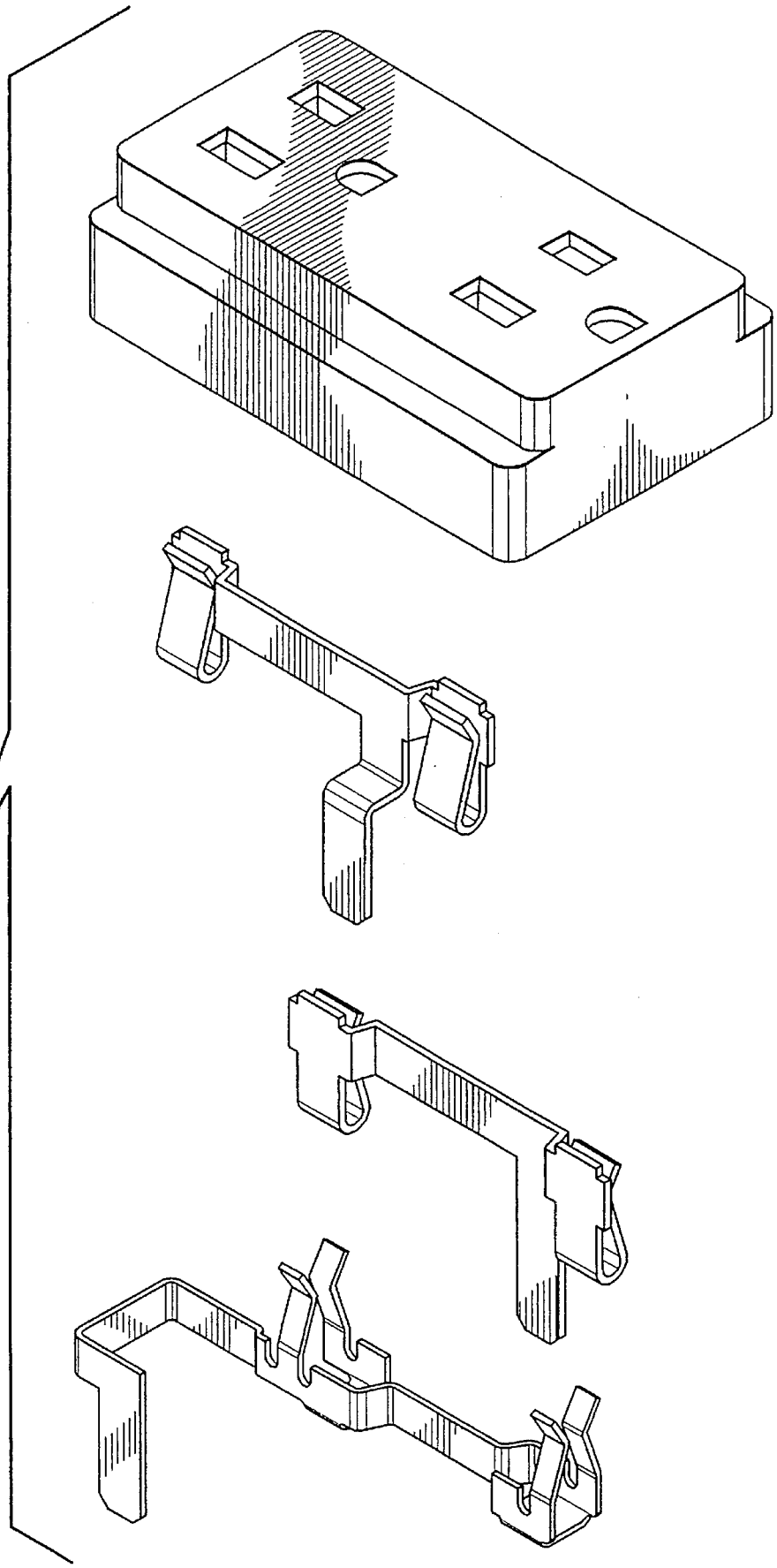
FIG. 1 Prior Art
FIG. 1 is a perspective exploded view of a connector of the prior art.
Figure 2:
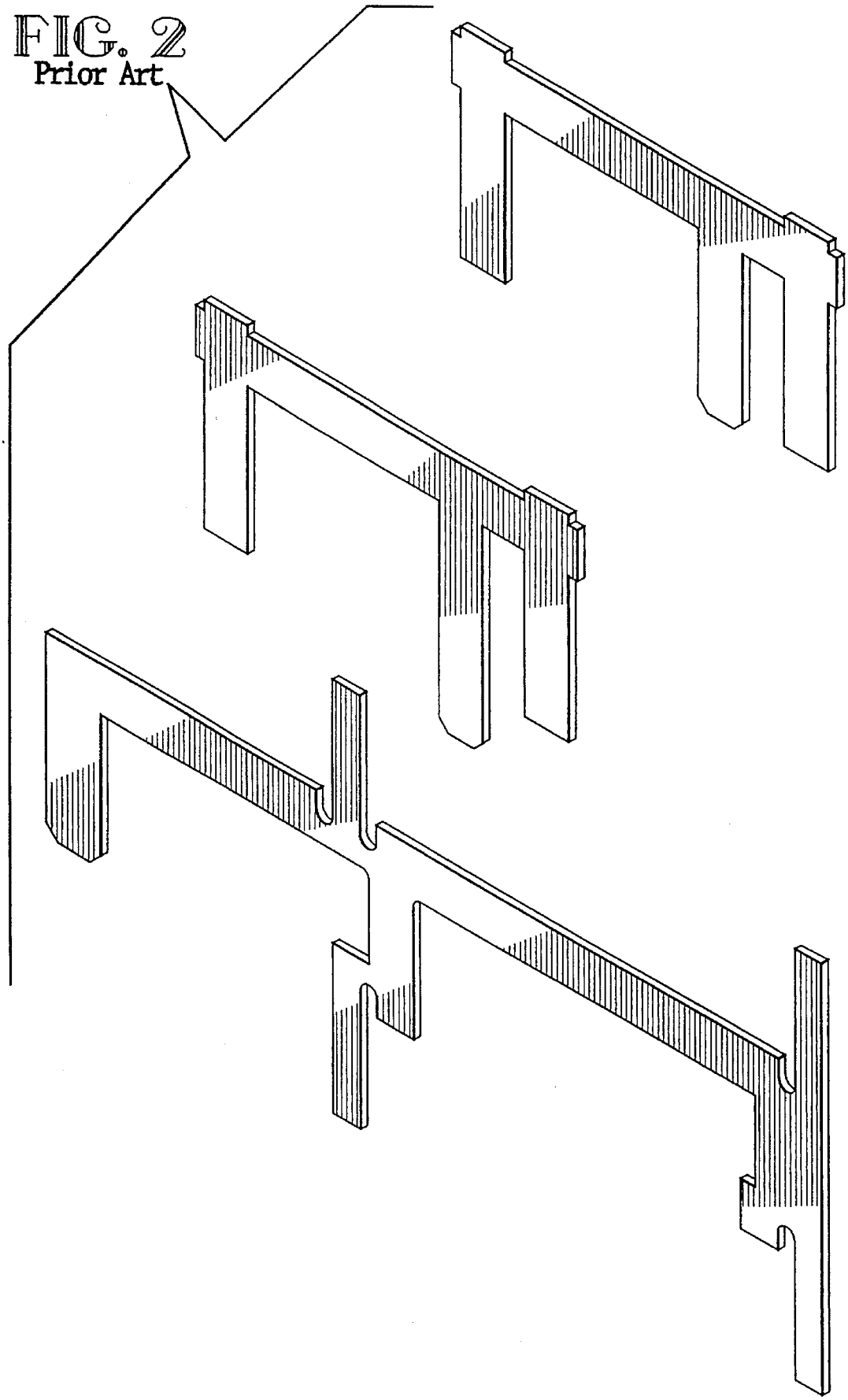
FIG. 2 Prior Art
FIG. 2 is a flat view of contacts of the prior art connector of FIG. 1.
Figure 3:
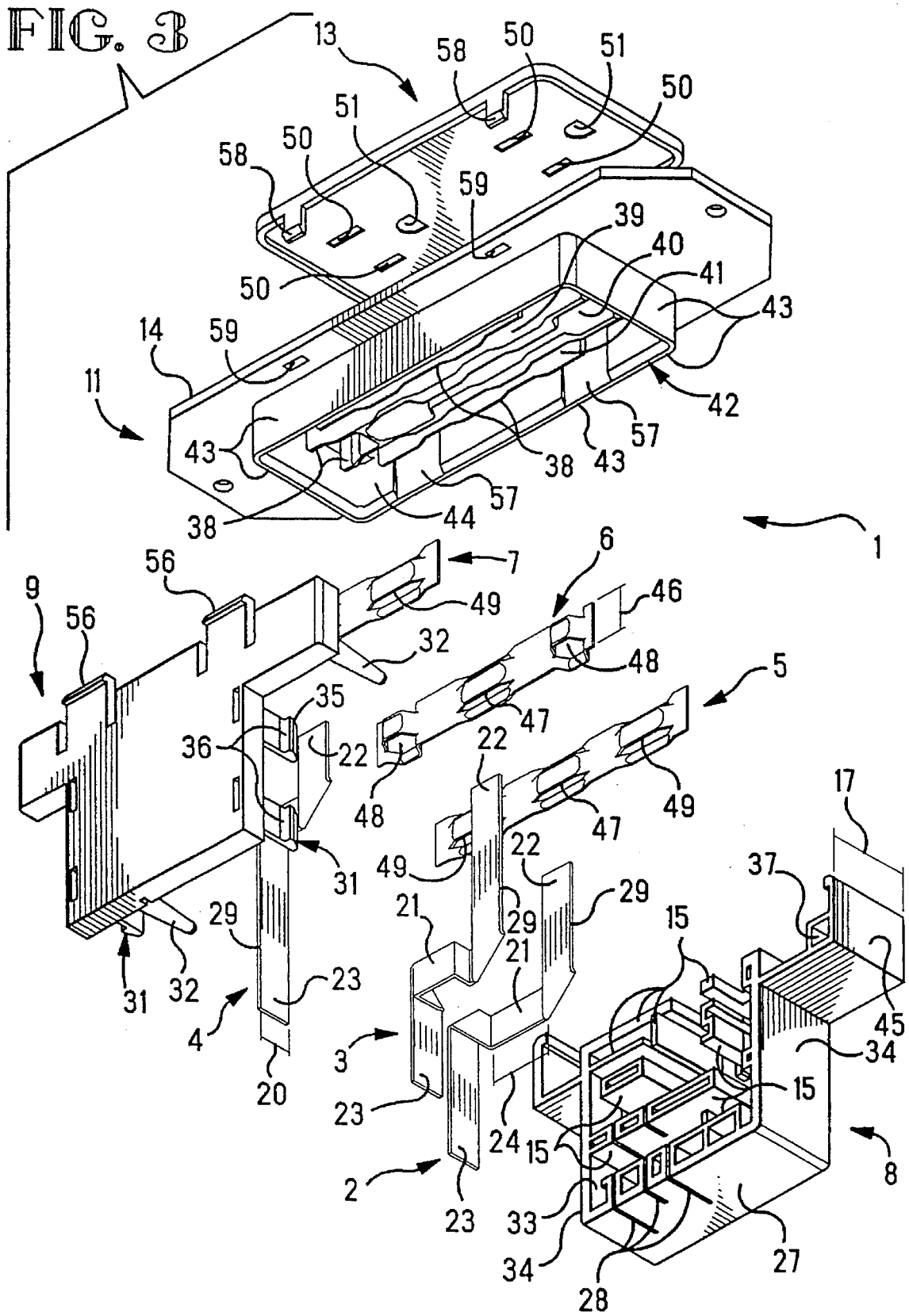
FIG. 3 is a perspective exploded view of a connector assembly of the present invention.
Figure 4:
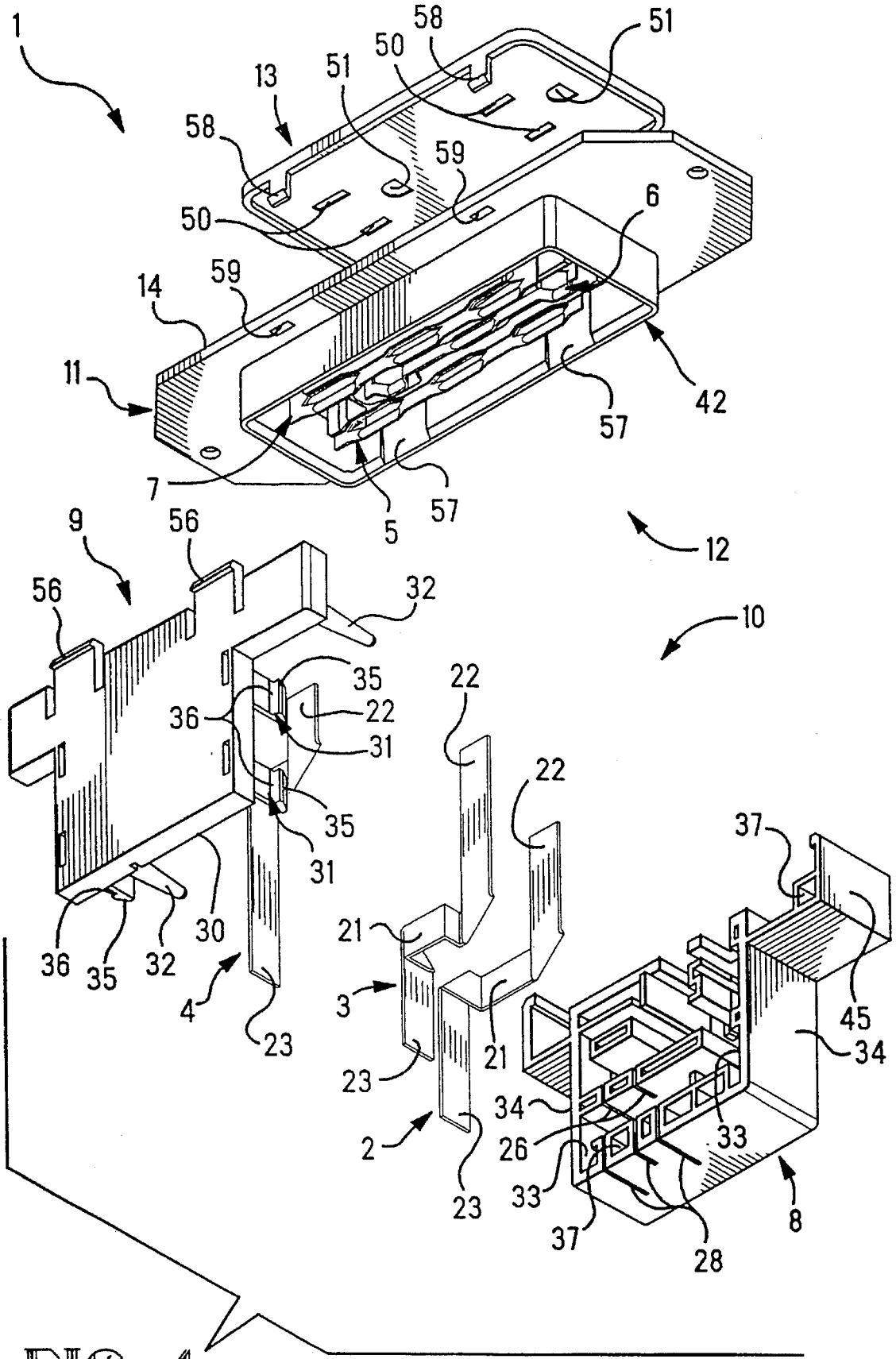
FIG. 4 is a perspective exploded view of the connector assembly of the present invention showing the socket buses positioned into their respective compartments in the socket housing.
Figure 5:
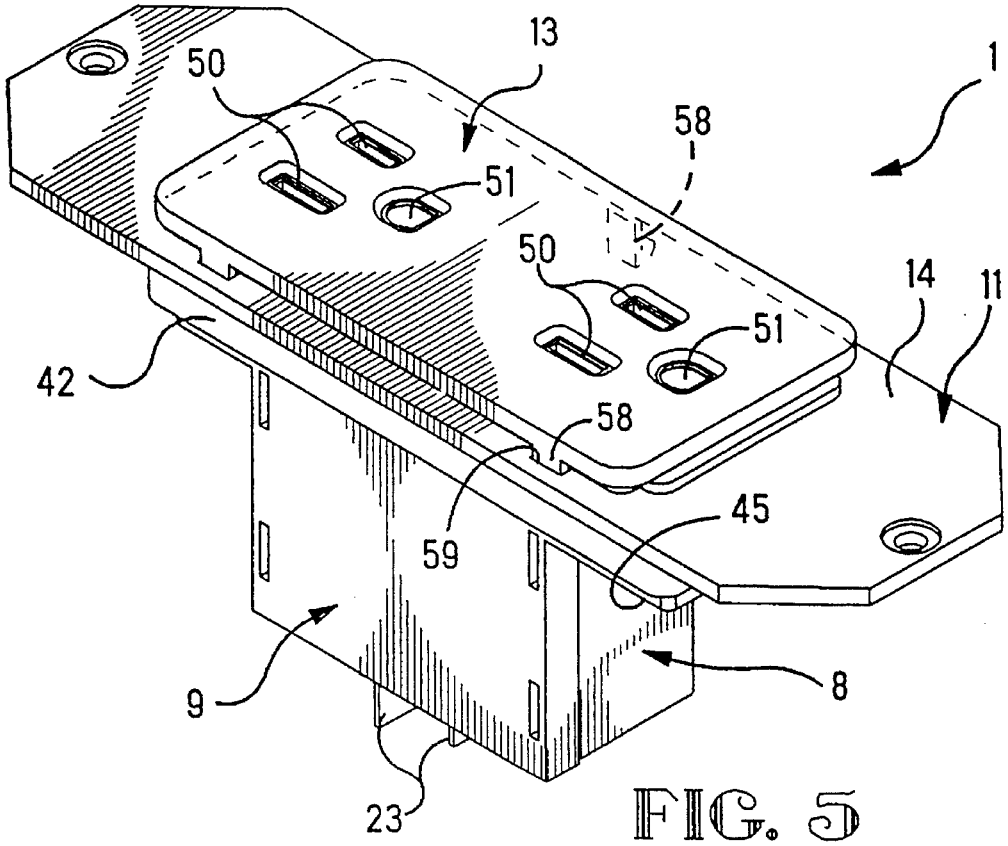
FIG. 5 is a perspective view of the assembled connector assembly of the present invention.

With reference to FIGS. 3–5, a connector assembly 1 includes hot, ground and neutral distribution blade buses 2, 3 and 4, respectively, and hot, ground and neutral socket buses 5, 6 and 7, respectively. A bus housing 8 accommodates and retains the distribution blade buses 2, 3 and 4 in predetermined positions. A bus housing cover 9 is secured on the bus housing 8 to further support and trap the distribution blade buses 2, 3 and 4 in place. The bus housing 8 (housing the distribution blade buses 2, 3, 4) and the bus housing cover 9 are snapped together to form a distribution subassembly 10.

Once the socket buses 5, 6, 7 are received in the predetermined positions in the socket housing 11, the socket subassembly 12 is formed.

The bus subassembly 10 and the socket subassembly 12 then are snapped together to form the connector assembly 1 with the distribution blade buses 2, 3, 4 mating with their respective socket buses 5, 6, 7.

A faceplate 13 is snapped onto the front surface 14 of the receptacle housing 11 to complete the connector assembly 1. The faceplate 13 can be colored in various colors to meet customers requirements.

Figure 8:
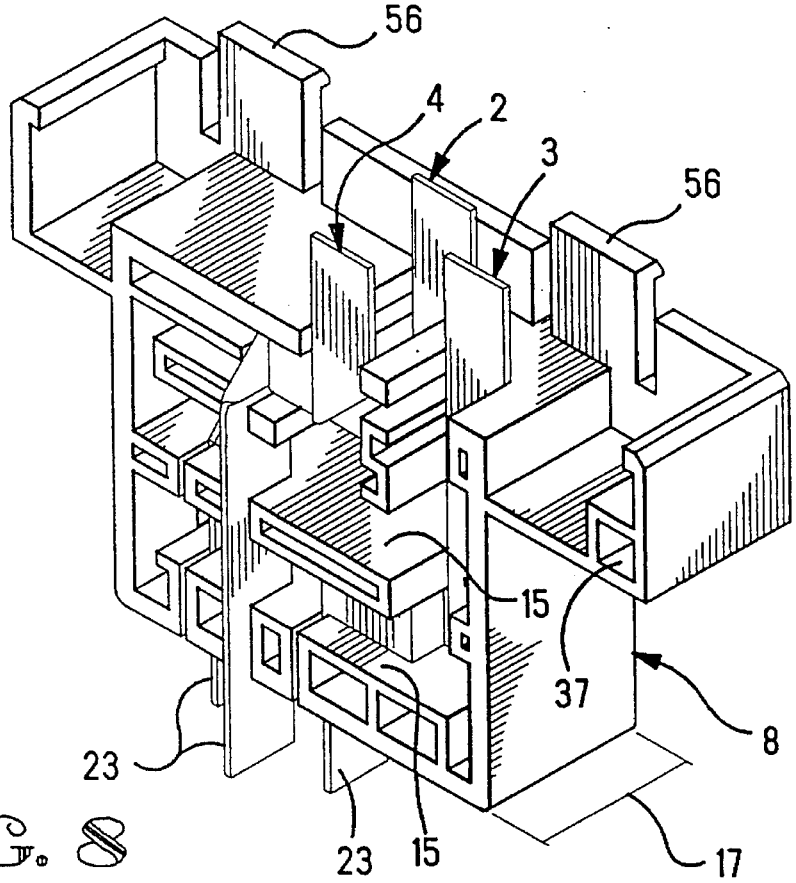
FIG. 8 is a perspective exploded view of the bus housing of the present invention showing all three distribution blade buses positioned into their respective predetermined compartments.
Figure 6:
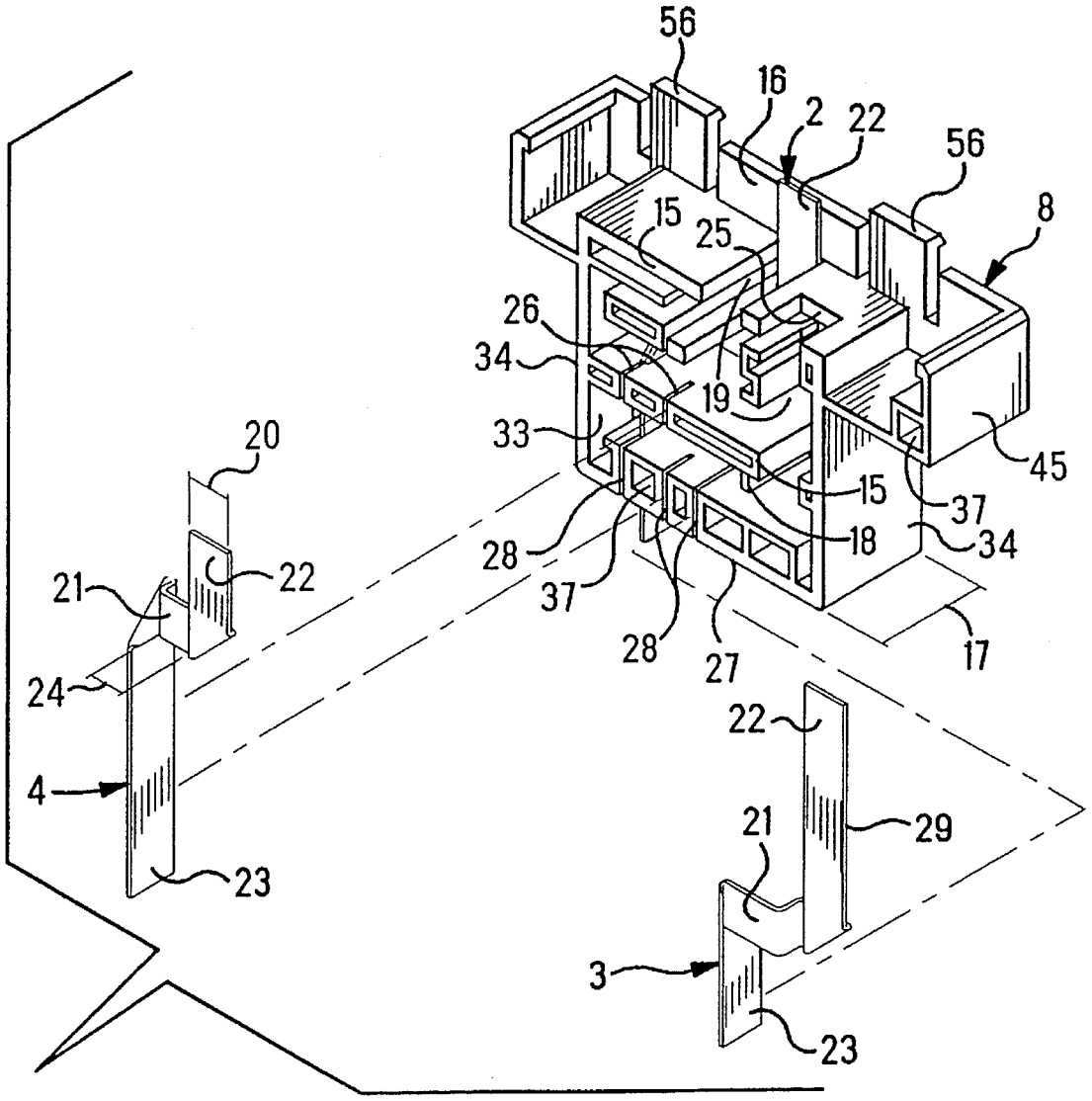
FIG. 6 is a perspective exploded view of the bus housing of the present invention showing one distribution blade bus have been positioned into predetermined compartment.
Figure 7:
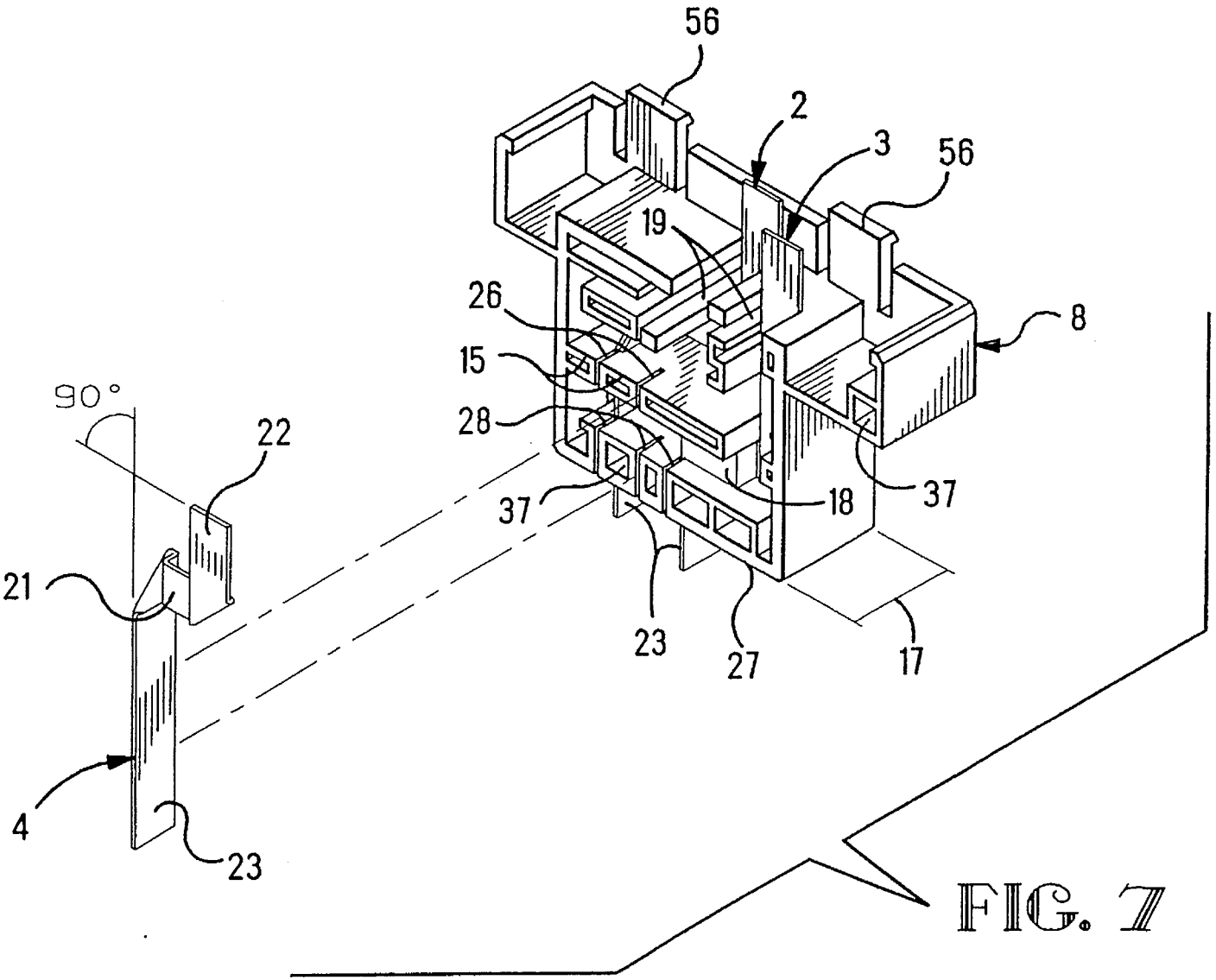
FIG. 7 is a perspective exploded view of the bus housing of the present invention showing two distribution blade buses positioned into respective predetermined compartments.

Referring to FIGS. 6–8, the bus housing 8 includes internal walls 15 which extend from the internal side 16 of the bus housing for the full width 17 of the bus housing 8 or less than the full width 17, thereby providing respective ledges 18 for supporting the respective portions of the distribution blade buses 2–4 within the bus housing 8. Having different mutual positioning within the bus housing 8, the walls 15 define compartments 19 of complicated shape for positioning the distribution blade buses 2, 3, 4 in predetermined order, as shown in FIGS. 6–8 in sequence.

The distribution blade buses 2, 3, 4 are made of brass strips of a respective uniform minimum width 20, thereby providing a "scrapless" design of the distribution blade buses 2, 3, 4, and folded to provide a central portion 21, a connection end 22, and a terminal end 23, respectively. The brass strip is folded in such a manner that the connection end 22 and the terminal end 23 are integrally connected by the central portion 21 at a right angle in relation to each other. Being positioned into the respective compartment 19 of the bus housing 8, the central portions 21 are supported by the respective ledges 18. Each ledge 18 has a width corresponding to the length 24 of the central portion 21 for which it is intended. The internal walls 15 also form ledges 25 for supporting connection ends 22 of the distribution blade buses 2, 3, 4. The ledges 25 have the width corresponding to the width 20 of the brass strips. It will be appreciated by those skilled in the art that the ledges 18, 25 are provided in minimal quantity needed for supporting the respective distribution blade bus.

The internal walls 15 also provide a plurality of slots 26 for receiving respective terminal ends 23. The bottom 27 of the bus housing 8 has three slots 28 through which the respective terminal ends 23 are protruded for plugging into a power supply (not shown). The slots 26 and 28 have the same width corresponding to the thickness 29 of the brass strip material; however each of slots 26, 28 has a different depth. In conjunction with different heights of the respective ledges 18, 25, the different depths of the slots 26, 28 provide spacing between the distribution blade buses 2, 3, 4 within the bus housing 8.

FIGS. 6–8 show the sequence of the positioning of the distribution blade buses 2, 3, 4 into the bus housing 8. In the embodiment described herein, the distribution blade buses 2, 3, 4 are positioned in the following order: the distribution blade bus 2 is positioned first; the distribution blade bus 3 is positioned second; and finally, the distribution blade bus 4 is positioned, such that each of the distribution blade buses 2, 3, 4 is positioned in the corresponding compartments 18 designed specifically for the respective distribution blade bus to be positioned therein. It will be appreciated by those skilled in the art, however, that another order of positioning the distribution blade buses 2, 3, 4 in the housing 8 may be chosen.

Referring again to FIGS. 3–5, after all distribution blade buses 2, 3, 4 have been positioned in bus housing 8, the bus housing cover 9 is snapped into position to further support and trap the distribution blade buses 2, 3, 4 in place. The bus housing cover 9 carries on its internal surface 30 a plurality of spaced-apart retention members 31 and aligning members 32. The retention members (tabs) 31 are extended from the internal surface 30 to be resiliently engaged with the respective areas (not shown) on the internal surfaces 33 of side walls 34 of the bus housing 8.

Referring now to FIGS. 3 and 4, each retention member 31 includes an enlarged end portion 35 having a respective retention ledge 36. Once the bus housing cover 9 is placed on the bus housing 8, the enlarged end portions 35 are snapped into the respective openings (not shown) on the internal surfaces 33 of the side walls 34 of the bus housing 8, and the retention ledges 36 retain the bus housing cover 9 in predetermined registration with the bus housing 8. The aligning members 32 are extended from the internal surface 30 of the bus housing cover 9 in shape of pins or fingers in order to facilitate aligning the bus housing cover 9 while being positioned on the bus housing 8. In the preferred embodiment the alignment members 32 are unsymmetrically positioned on cover 9 to assure that the distribution subassembly 10 is assembled properly. Each aligning member 32 is received into a respective opening 37 on the bus housing 8, the openings 37 being defined by the internal walls 15 of the bus housing 8. Once the bus housing cover 9 and the bus housing 8 are snapped together, they optionally can be heat staked.

Referring again to FIGS. 3 and 4, the socket housing 11 has molded cavities to trap and retain the socket busses 5, 6, 7 in the proper location for mating with the distribution bus blades 2, 3, 4 when socket subassembly 12 is assembled to distribution subassembly 10. The socket housing 11 includes molded internal walls 38 which are extended from the socket housing 11 inner surface on the height corresponding to the width of the brass socket buses 5, 6, 7 and define respective compartments 39, 40, 41 for the socket buses 5, 6, 7. Once the socket buses 5, 6, 7 are received into the respective compartments 39, 40, 41 (the order in which the socket buses 5, 6, 7 are assembled in the respective compartments is unimportant), the socket subassembly 12 is formed. In the preferred embodiment, the socket buses 5, 6, 7 are rotatable front to back and are completely symmetrical both left and right and top and bottom. Thus, the socket buses require no special orientation before they are assembled into the socket housing 11, other than placing the ground bus terminal bus 6 between the other two buses 5 and 7. The socket housing 11 also includes a retaining lower member 42 which includes four (4) connected retaining walls 43. The retaining walls 43 extend from the inner surface of the socket housing 11 for a height larger than the height of the walls 38 and surround the internal walls 38. The retaining walls 43 form a cavity 44 for receiving an upper portion of the bus housing 8. The height of the retaining walls 43 allows a sufficient area of overlapping with the upper portion 45 of the bus housing 8 to retain the socket subassembly 12 on the distribution subassembly 10. If desired (but not necessary), the socket assembly 12 and the distribution subassembly 10 can be heat staked together.

Each socket bus 5, 6, 7 is made of an integral brass strip of uniform width 46 and has three respective spaced-apart openings 47, 48 and 49. The openings 47, 48 and 49 are formed as slits, extending longitudinally of the strip (or bus) and are lanced out such that no material is scrapped from each strip.

Referring to FIGS. 3–5 and 9–10, two (2) socket buses, for example, 5 and 7, are identical, and the openings 47, 48, 49 located on each socket bus 5, 7 are substantially similar. The openings 47, located between the openings 49 (for socket buses 5 and 7) or between the openings 48 (for the socket bus 6), serve for receiving the respective connection ends 22 of the respective distribution blade buses 2, 3, 4 (input blades), which thereby supply power to the socket buses 5, 6, 7. The openings 49 of the socket buses 5 and 7, being aligned with respective openings 50 located on the faceplate 13, and at the same time being in precise registration with respective openings (not shown) on the front surface 14 of the socket housing 11, serve for receiving and retaining respective terminals of the entry adapter of a compatible equipment to be powered (not shown) or output terminals (blades) of another electrical device (not shown). The socket bus 6 differs from socket buses 5 and 7 since openings 48 spaced apart from the opening 47 are specifically designed for receiving a respective entry ground terminal of equipment to be powered, and thus they differ from openings 49. For example, this can be configured to receive a substantially round ground pin on a grounding electrical plug. The openings 48 are aligned with respective openings 51 on the faceplate 13 and with respective openings (not shown) on the front surface 14 of the receptacle housing 11. Each socket bus is symmetrical relative to its longitudinal axis.

Figure 9:
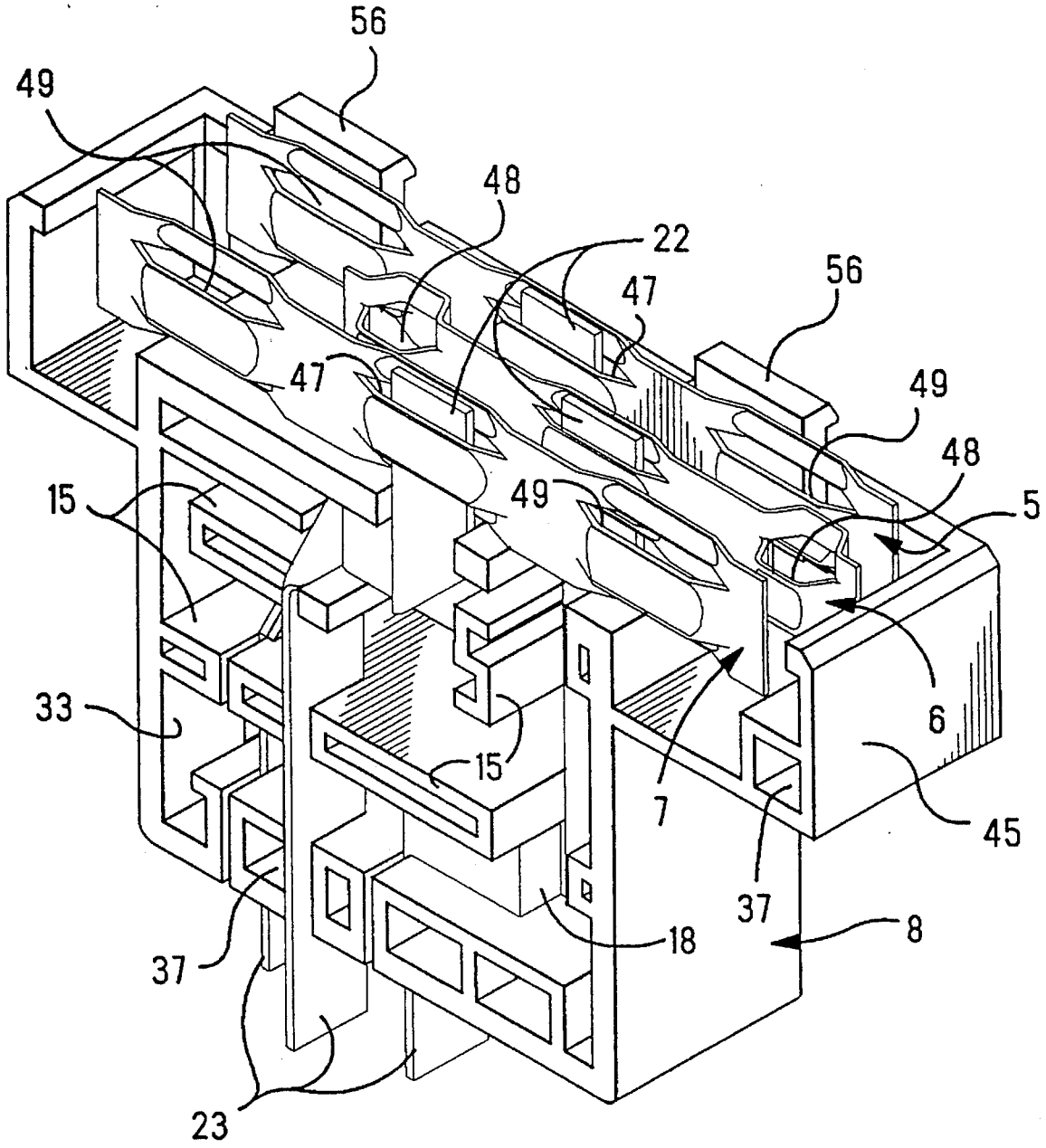
FIG. 9 is perspective view of FIG. 8 showing a mutual positioning of the distribution blade buses with the socket buses.
Figure 10:
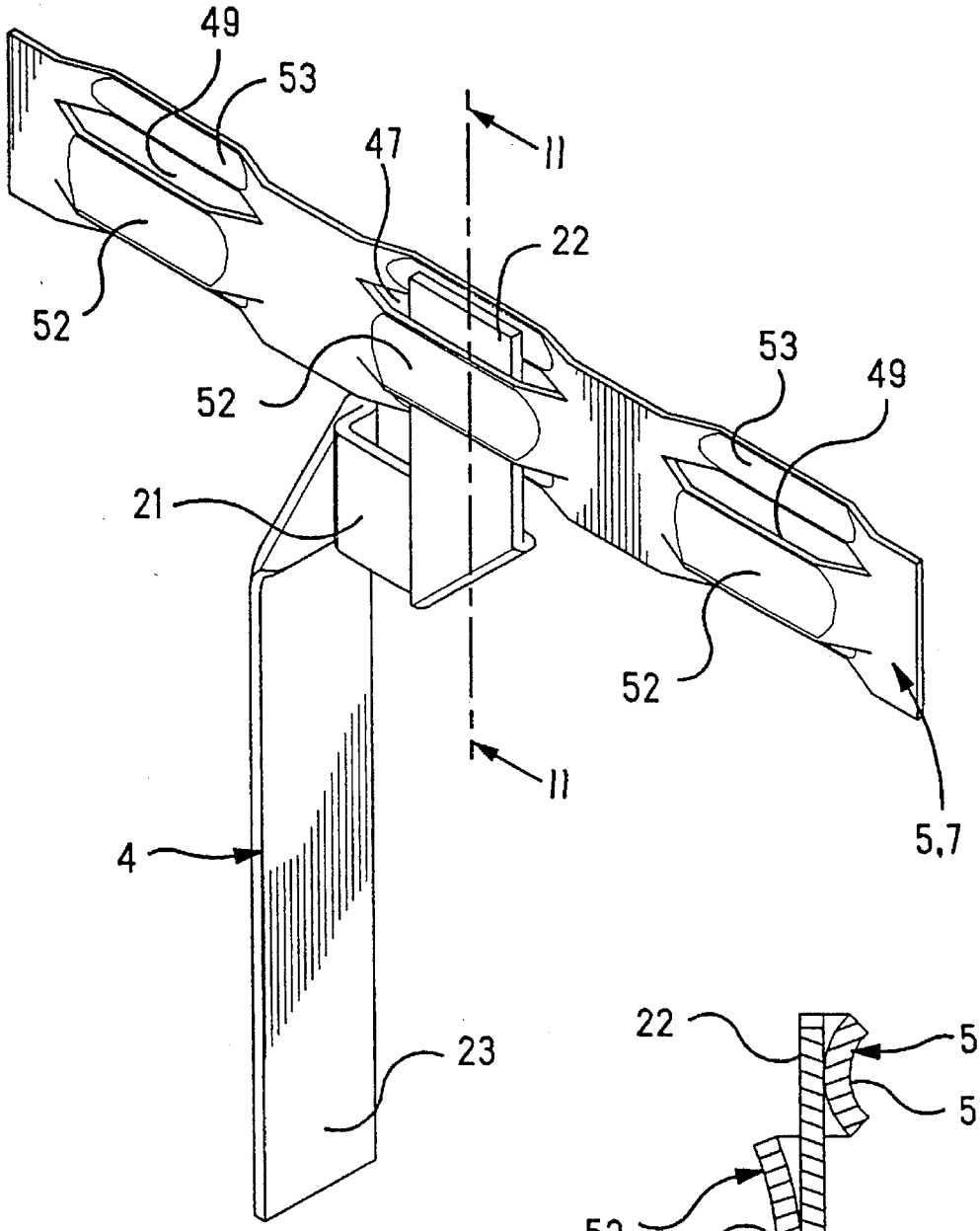
FIG. 10 is an enlarged perspective view of one of the distribution blade buses with the connection end in the respective slit of the socket bus.
Figure 11:
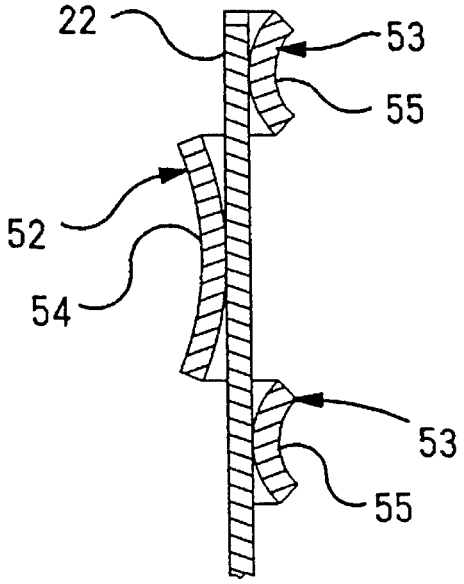
FIG. 11 is a partial cross-sectional view of FIG. 10 taken along lines 11—11 thereof.

Referring to FIGS. 9, 10 and 11 showing an interconnection between the distribution blade buses 2, 3, 4 and the respective socket buses 5, 6, 7 in the connector assembly 1 of the present invention, each opening 47, 48, 49 includes a front retention portion 52 and two rear retention portions 53. The front retention portion 52 and the rear retention portions 53 are formed from the respective integral brass socket strip by blanking operation and stamped for connection purposes to form respective convex surfaces 54, 55 toward the respective connection end 22 of the respective socket buses 5, 6, 7 (for openings 47) or toward the respective entry terminals (not shown) of the equipment to be powered (for openings 48, 49).

Referring again to FIGS. 3, 4 and 6–9, both the bus housing cover 9 and the bus housing 8 include retention fingers 56 which being received in respective slots 57 on the socket housing 11, facilitate in snapping together the bus housing 8 and the bus housing cover 9 and the distribution subassembly 10 and the socket subassembly 12. In the preferred embodiment the retention fingers 56 on bus housing 8 are offset with respect to those on cover 9. The slots 57 on the corresponding sides of socket housing 11 are similarly offset to assure that the parts are assembled properly. Retention tabs 58 and slots 59 on the faceplate 13 and on the socket housing 11, respectively, facilitate in snapping said parts together. There are two retention labs 58 on one side and one retention finger 58 on another side of the faceplate, respectively, again to assure that the parts are assembled properly. The single retention tab 58 is shown in FIG. 8 in phantom.

Accordingly, the present invention provides a superior connector assembly, having relatively low material and is cost effective to make and assemble. The distribution blade buses and the socket buses are of a "scrapless" design whereby they are folded and formed from strip stock with very little or no scrap material cut out between socket buses and distribution blade buses. The plastic parts (bus housing, bus housing cover, socket housing and faceplate) retain three distribution blade buses and three socket buses in a "snap" together design wherein any misalignments between the parts is accommodated without the use of fasteners, adhesives, welding, etc., or any secondary operations.

The embodiment of the present invention (described herein) is intended for a duplex receptacle power block; however, the teachings of the present invention are equally applicable to any power or data connectors whereby the distribution subassembly can be separated from the socket subassembly of the connector assembly. With only six metal parts (three distribution blade buses and three socket buses) and four plastic parts (bus housing, bus housing cover, socket housing and faceplate) the connector assembly can be very efficiently assembled at various production volumes. As demand volume increases, a simple index table with pick and place arms (not shown) can be used to provide complete automatic assembly. A snap-on faceplate is used to color the front of the connector assembly to match the customers requirements.

Obviously, many modifications may be made without departing from the basic spirit of the present invention. Accordingly, it will be appreciated by those skilled in the art that within the scope of the appended claims, the present invention maybe practiced other than has been specifically described herein.

What is claimed is:

1. A connector assembly comprising:

a socket subassembly removably attached to a distribution subassembly in predetermined interposition;

said distribution subassembly including a bus housing accommodating and retaining distribution blade buses in respective predetermined pathways, and a bus housing cover secured to the bus housing and providing means for further supporting and retaining said distribution blade buses within the bus housing;

said socket subassembly including a socket housing retaining socket buses in predetermined positions;

each of said distribution blade buses comprising an integral metal bus strip having a substantial uniform width, each of said bus strips includes a connection end and a terminal end, respectively, at least one said bus strip being folded across its width to define first and second portions on respective sides of said fold extending to respective ones of said connection and terminal ends, the first and second portions extending in different directions complementary to a said respective predetermined pathway for said bus strip in the bus housing; and each of said socket buses comprising an integral metal socket strip, respectively, each socket strip having a respective first opening for receiving the connection end of the respective bus strip, thereby providing electrical connection of each socket bus to the respective distribution blade bus.

2. The connector assembly according to claim 1, wherein said distribution blade buses include hot, ground and neutral distribution buses, respectively, wherein said socket buses include hot, ground and neutral socket buses, respectively, and wherein the bus housing provides respective slots through which the terminal ends of the hot, the ground and the neutral distribution buses protrude for plugging into a power supply.

3. The connector assembly according to claim 1, wherein the socket housing further includes molded internal walls defining respective compartments for receiving the respective socket buses and retaining the respective socket buses in the predetermined positions.

4. The connector assembly according to claim 1, wherein the bus housing further includes respective internal walls defining respective compartments for receiving the respective distribution blade buses in predetermined order and retaining the respective distribution blade buses in the predetermined positions.

5. The connector assembly according to claim 1, wherein each of the socket buses further includes a second and a third opening for receiving entry terminals of equipment to be powered, said second and the third openings being in juxtaposition with the first opening, and wherein the respective first, second and third openings in the socket strips comprise respective slits.

6. The connector assembly according to claim 1, wherein each distribution blade bus further includes a central portion connecting the connection end and the terminal end at a right angle to each other.

7. The connector assembly according to claim 1, further including a faceplate removably attached to the socket housing.

8. An electrical connector comprising distribution blade buses and socket buses, wherein each of the distribution blade buses includes a metal strip having a substantially uniform width, each said bus strip being folded across its width at two locations therealong to define a transverse portion therebetween at a selected location intermediate a connection end and a terminal end, wherein the connection end and the terminal end are integrally connected and mutually offset from one another, and extend in parallel directions complementary to a respective predetermined pathway for said bus strip in the bus housing and wherein each of socket buses includes a metal strip having a respective first slit for removably receiving the connection end of the respective distribution blade bus.

9. The electrical connector of claim 8, wherein each of socket buses includes a second and a third spaced-apart slits, and wherein said second and third slits are juxtapositioned and parallel to the first slit.

10. The electrical connector of claim 9, wherein each distribution blade bus is formed and wherein the first, second and the third slits in the socket bus are lanced out such that no material is scrapped.

11. A method of assembling a connector assembly including the steps of:

providing a bus housing having a plurality of internal walls defining respective compartments for accommodating distribution blade buses;

providing distribution blade buses, each distribution blade bus being formed from a metal strip and formed to provide a connection end, a terminal end and a central portion integrally connecting the connection end and the terminal end at a right angle to each other;

positioning the distribution blade buses into respective compartments of the bus housing in predetermined order;

providing a bus housing cover;

securing the bus housing cover to the bus housing, thereby forming a distribution subassembly;

providing a socket housing, the socket housing having a plurality of internal walls defining compartments for accommodating respective socket buses;

providing socket buses, each socket bus being formed from a metal bus strip and lanced out to provide a first, a second and a third spaced-apart parallel slits, wherein the first slits are for receiving the connection end of the respective distribution blade bus, and wherein the second and the third slits are for receiving respective entry terminals of equipment to be powered;

positioning the socket buses into respective compartments of the socket housing; and securing the socket housing to the distribution subassembly with the respective connection ends of the respective distribution blade buses received within the respective first slits.

12. The method according to claim 11, wherein the bus housing cover is snapped into the bus housing.

13. The method according to claim 11, wherein the bus housing cover is heat staked with the bus housing.

14. An electrical device including a bus formed from a metal strip and at least one input blade, the bus including a plurality of sockets, each defined by a slit extending longitudinally along a portion of the bus and a portion of the bus adjacent the slit extending transversely of the bus, at least one of the sockets being configured to receive the input blade configured for connection to a source of electricity and at least one of the sockets being configured to receive an output blade from a second electrical device.

15. The electrical device of claim 14, wherein each socket is formed by at least two portions of the bus on opposite sides of the slit, the two portions of the bus extending in opposite transverse directions.

16. The electrical device of claim 15, wherein the bus is symmetrical relative to the longitudinal axis of the bus.

17. The electrical device of claim 16, wherein the sockets are configured to receive input blades and output blades from opposite sides.

18. The electrical device of claim 14, wherein the bus and the input blade are mounted in a housing, the housing including an opening through which the input blade from the second electrical device can be inserted.

19. The electrical device of claim 18, wherein the input blade extends into the bus from a first direction transverse to the longitudinal axis of the slit forming its corresponding socket, and the housing opening extends from an opposite direction also transverse to the longitudinal axis of the slit forming its corresponding socket.

20. The electrical device of claim 18, wherein the input blade is flat and the socket for receiving the output blade is configured to receive a substantially round ground pin on a grounding electrical plug.

21. The electrical device of claim 20, wherein the input blade has flat terminal portions on each end.

22. A connector assembly of claim 1 wherein said at least one bus strip includes a second fold at a second selected location to define a transverse portion intermediate said folds whereby said connection and terminal ends are mutually offset from each other.

* * * * *